US009504298B2

(12) United States Patent
Li

(10) Patent No.: US 9,504,298 B2
(45) Date of Patent: Nov. 29, 2016

(54) AUTOMATIC TILT MECHANISM AND AN UMBRELLA HAVING THE SAME

(71) Applicant: ATLEISURE, LLC, Atlanta, GA (US)

(72) Inventor: Chuan Li, Atlanta, GA (US)

(73) Assignee: Atleisure LLC, Atlanta, GA (US)

( * ) Notice: Subject to any disclaimer, the term of this patent is extended or adjusted under 35 U.S.C. 154(b) by 306 days.

(21) Appl. No.: 14/309,666

(22) Filed: Jun. 19, 2014

(65) Prior Publication Data

US 2015/0366304 A1 Dec. 24, 2015

(51) Int. Cl.
*A45B 17/00* (2006.01)
*A45B 25/14* (2006.01)

(52) U.S. Cl.
CPC ..... *A45B 17/00* (2013.01); *A45B 2025/146* (2013.01)

(58) Field of Classification Search
CPC ..... A45B 17/00; A45B 2025/146
USPC ..... 135/20.1
See application file for complete search history.

(56) References Cited

U.S. PATENT DOCUMENTS

| | | | |
|---|---|---|---|
| 2,721,569 | A | 10/1955 | Militano |
| 2,819,725 | A | 1/1958 | Deisenroth et al. |
| 3,150,671 | A | 9/1964 | Frey |
| 3,410,285 | A | 11/1968 | Small |
| 3,744,503 | A | 7/1973 | Wolff et al. |
| 4,877,045 | A | 10/1989 | Lin |
| 4,878,509 | A | 11/1989 | Tung |
| 5,029,596 | A | 7/1991 | Tung |
| 5,711,331 | A | 1/1998 | Harris |
| 6,230,724 | B1 | 5/2001 | Lai |
| 6,311,705 | B1 | 11/2001 | Ma |
| 6,446,650 | B1 | 9/2002 | Ma |
| 6,575,182 | B2 | 6/2003 | Tung |
| 6,575,183 | B2 | 6/2003 | Tung |
| 6,622,741 | B2 | 9/2003 | Lai |

(Continued)

FOREIGN PATENT DOCUMENTS

| | | | |
|---|---|---|---|
| DE | 20016372 | U1 | 1/2001 |
| DE | 202011002159 | U1 | 6/2011 |
| EP | 2668866 | A1 | 4/2013 |
| GB | 1357870 | A | 6/1974 |

OTHER PUBLICATIONS

International Search Report and Written Opinion mailed Feb. 27, 2015 in International Application No. PCT/US2014/043656 filed Jun. 23, 2014.

*Primary Examiner* — David R Dunn
*Assistant Examiner* — Danielle Jackson
(74) *Attorney, Agent, or Firm* — ATLawip LLC; Jeffrey T. Breloski

(57) ABSTRACT

Present invention relates to a tilting mechanism for an umbrella. The tilting mechanism includes: a base, a body, a sliding rod, and a winding device. The base has base pin holes and the body has body pin holes. The base and the body are joined by a pin through the base and body pin holes to form a joint. When umbrella is in upright and closed position, a user turns the crank clockwise, the cord is pulled downwards, a runner of the umbrella is moved upwards to open the umbrella until the runner is stopped by a runner stopper. When the umbrella is in open position, the user continues to turn the crank clockwise, the cord is pulled further down, the sliding rod is moved downwards pushing the wheel to travel along a wheel moving surface, and wheel axle grooves push wheel axle to tilt body around the pin.

13 Claims, 7 Drawing Sheets

(56) References Cited

U.S. PATENT DOCUMENTS

| | | | | |
|---|---|---|---|---|
| 6,722,381 | B2 | 4/2004 | Lai | |
| 6,810,892 | B2 | 11/2004 | Lai | |
| 7,174,905 | B2 | 2/2007 | Hung | |
| 7,406,976 | B1 | 8/2008 | Chan et al. | |
| 7,412,985 | B2 | 8/2008 | Ma | |
| 7,438,077 | B1 | 10/2008 | Wilson | |
| 8,272,391 | B2 | 9/2012 | Luo | |
| 8,522,804 | B1 | 9/2013 | Tung | |
| 8,534,304 | B1 | 9/2013 | Tung | |
| 8,763,620 | B1 * | 7/2014 | Tung | A45B 25/14 135/20.1 |
| 8,776,809 | B2 * | 7/2014 | Ma | A45B 17/00 135/20.1 |
| 8,899,250 | B1 * | 12/2014 | Tung | A45B 25/14 135/20.1 |
| 2013/0206192 | A1 | 8/2013 | Ma et al. | |

* cited by examiner

AUTOMATIC TILT MECHANISM AND AN UMBRELLA HAVING THE SAME

FIELD OF THE INVENTION

The present invention relates to the field of large umbrella, and more particularly to an automatic mechanism for large umbrellas and an automatic large umbrella.

BACKGROUND OF THE INVENTION

Oversized umbrellas are widely used in the patio, markets, as well as beaches. They provide users with protections from the sun burn, or rain. Traditional oversized umbrellas are straight up umbrellas. If there is a possibility the top of the oversized umbrella to tilt towards certain direction, the umbrella usually has a button and the user has to press the button to unlock a locking mechanism such that the umbrella can tilt. It usually requires the use of both hands, and the user is unable to use a winding device to open or close the umbrella, and tilt the umbrella. It is desirable to have an automatic umbrella that the user can open and close the umbrella, and adjust with one hand using the winding device.

Therefore, a heretofore unaddressed need exists in the art to address the aforementioned deficiencies and inadequacies.

SUMMARY OF THE INVENTION

In one aspect, the present invention relates to a tilting mechanism used in an umbrella. In certain embodiments, the tilting mechanism includes (a) a base, (b) a body, (c) a sliding rod, and (d) a winding device. The base of the tilting mechanism has a base pin hole defined substantially perpendicular to the upright direction of the base, and the base pin hole is positioned adjacent to one side of the base. The base has a wheel moving surface and the wheel moving surface is slanted against the upright direction of the base. The base also has a wheel axle guiding groove and a base mounting hole defined at a lower portion of the base. The body has a round upper portion and a U-shaped lower portion. The U-shaped lower portion forms a wheel holder. The wheel holder has a wheel axle groove on each side of the U-shaped lower portion, a pin positioned in a body pin hole defined in the U-shaped lower portion. The pin extends to the base pin hole of the base to form a joint. The joint joins the base and body. The body also has a body mounting hole defined at the round upper portion of the body. The sliding rod has a pulley axle for mounting a pulley through a pulley slot, a link pin for linking an angular link rod. The angular link rod has a first end connected through the link pin to the sliding rod, and a second end connected to a wheel through a wheel axle. The wheel axle extends to the wheel axle grooves on each side of the U-shaped lower portion of the body. The winding device is installed on a lower shaft of the umbrella. The winding device has a crank, and a cord. The cord has a first end, and a second end. The first end is connected to a first cord stop on a crank axle of the crank. The second end is connected to a second cord stop on a runner of the umbrella through a pulley positioned on the sliding rod.

In certain embodiments, when the umbrella is in upright and closed position, a user turns the crank clockwise, the cord is pulled downwards, and the runner is moved upwards to open the umbrella until the runner is stopped by a runner stopper. When the umbrella is in upright and open position, the user continues to turn the crank clockwise, the cord is pulled further down, the sliding rod is pushed downwards causing the wheel to travel along the wheel moving surface, and the wheel axle grooves push the wheel axle to tilt the body around the pin.

In certain embodiments, the body further includes a restricting pin, a spring, a first washer positioned on top of the body, and a second washer positioned under the restricting pin. The spring is positioned between the first washer and the second washer to provide a resilient force to keep the sliding rod away from the body and maintain the wheel axle in its highest position of the wheel axle grooves, when the umbrella is in upright and open position. The base mounting hole is adapted for mounting the base on top of the lower shaft of the umbrella. The body mounting hole is adapted for mounting the body at bottom of an upper shaft of the umbrella.

The upper shaft has a cord through slot defined along the upright direction having a predetermined length to allow the cord to pass from inside of the upper shaft to the runner and the pulley to move up and down along the upright direction. The first end of the cord is connected to the first cord stop, and the second end of the cord is connected to the runner. The cord passes from inside of the lower shaft, through the base, the body, inside of the upper shaft, the pulley, through the cord through slot to come out of the upper shaft and connect to the second cord stop. The runner stopper is positioned on the upper shaft to stop the runner when the umbrella is in upright and open position.

In certain embodiments, the sliding rod has a sliding rod top ring, a sliding rod top ring mounting hole defined substantially perpendicular to the upright direction of the base through the sliding rod top ring, and two mounting screws to mount the sliding rod top ring on the top end of the sliding rod. The sliding rod has a pulley slot adapted for installing the pulley on a pulley axle. The sliding rod is slidably positioned inside of the upper shaft. The position of the sliding rod is controlled by the cord through the pulley to allow the sliding rod to move down to tilt the upper shaft of the umbrella, or move up to return the upper shaft of the umbrella to upright position.

In certain embodiments, the winding device has a crank axle, and the crank axle has a cord through hole defined substantially parallel to the upright direction of the base through the crank axle. The cord through hole holds the first end stop at the first end of the cord, and pulls the cord down when the user turns the crank clockwise to open the umbrella and tilt the top portion of the umbrella. When the user turns the crank counterclockwise, the cord through hole releases the cord to allow the cord to move up at the resilient force of the spring to move the top of the umbrella to upright position, and allow the gravitational force of the umbrella acting on the runner of the umbrella to close the umbrella. The present invention also relates to an umbrella having such a tilting mechanism.

In another aspect, the present invention relates to an automatic tilt umbrella. In certain embodiments, the automatic tilt umbrella has (a) a lower shaft, (b) an upper shaft, (c) a predetermined number of ribs, (d) the same predetermined number of stretchers, (e) a top cap, (f) a runner, and (g) a tilting mechanism. Each of the lower shaft, and the upper shaft has an upper end and a lower end. A first end of each of the ribs is connected to the top cap. The runner is slidably positioned on the upper shaft to open, tilt, and close the umbrella. A first end of each of the stretchers is connected to the runner, and a second end of each of the stretchers is connected to a predetermined position on each of the ribs, respectively.

In certain embodiments, the automatic tilt umbrella has a tilting mechanism. The tilting mechanism includes (a) a base, (b) a body, (c) a sliding rod, and (d) a winding device. The base of the tilting mechanism has a base pin hole defined substantially perpendicular to the upright direction of the base, and the base pin hole is positioned adjacent to one side of the base. The base has a wheel moving surface and the wheel moving surface is slanted against the upright direction of the base. The base also has a wheel axle guiding groove and a base mounting hole defined at a lower portion of the base. The body has a round upper portion and a U-shaped lower portion. The U-shaped lower portion forms a wheel holder. The wheel holder has a wheel axle groove on each side of the U-shaped lower portion, a pin positioned in a body pin hole defined in the U-shaped lower portion. The pin extends to the base pin hole of the base to form a joint. The joint joins the base and body. The body also has a body mounting hole defined at the round upper portion of the body. The sliding rod has a pulley axle for mounting a pulley through a pulley slot, a link pin for linking an angular link rod. The angular link rod has a first end connected through the link pin to the sliding rod, and a second end connected to a wheel through a wheel axle. The wheel axle extends to the wheel axle grooves on each side of the U-shaped lower portion of the body. The winding device is installed on the lower shaft of the umbrella. The winding device has a crank, and a cord. The cord has a first end, and a second end. The first end is connected to a first cord stop on a crank axle of the crank. The second end is connected to a second cord stop on a runner of the umbrella through a pulley positioned on the sliding rod.

In certain embodiments, when the umbrella is in upright and closed position, a user turns the crank clockwise, the cord is pulled downwards, and the runner is moved upwards to open the umbrella until the runner is stopped by a runner stopper. When the umbrella is in upright and open position, the user continues to turn the crank clockwise, the cord is pulled further down, the sliding rod is pushed downwards causing the wheel to travel along the wheel moving surface, and the wheel axle grooves push the wheel axle to tilt the body around the pin.

In certain embodiments, the body further includes a restricting pin, a spring, a first washer positioned on top of the body, and a second washer positioned under the restricting pin. The spring is positioned between the first washer and the second washer to provide a resilient force to keep the sliding rod away from the body and maintain the wheel axle in its highest position of the wheel axle grooves, when the umbrella is in upright and open position. The base mounting hole is adapted for mounting the base on top of the lower shaft of the umbrella. The body mounting hole is adapted for mounting the body at bottom of the upper shaft of the umbrella.

The upper shaft has a cord through slot defined along the upright direction having a predetermined length to allow the cord to pass from inside of the upper shaft to the runner and the pulley to move up and down along the upright direction. The first end of the cord is connected to the first cord stop, and the second end of the cord is connected to the runner. The cord passes from inside of the lower shaft, through the base, the body, inside of the upper shaft, the pulley, through the cord through slot to come out of the upper shaft and connect to the second cord stop. The runner stopper is positioned on the upper shaft to stop the runner when the umbrella is in upright and open position.

In certain embodiments, the sliding rod has a sliding rod top ring, a sliding rod top ring mounting hole defined substantially perpendicular to the upright direction of the base through the sliding rod top ring, and two mounting screws to mount the sliding rod top ring on the top end of the sliding rod. The sliding rod has a pulley slot adapted for installing the pulley on a pulley axle. The sliding rod is slidably positioned inside of the upper shaft. The position of the sliding rod is controlled by the cord through the pulley to allow the sliding rod to move down to tilt the upper shaft of the umbrella, or move up to return the upper shaft of the umbrella to upright position.

In certain embodiments, the winding device has a crank axle, and the crank axle has a cord through hole defined substantially parallel to the upright direction of the base through the crank axle. The cord through hole holds the first end stop at the first end of the cord, and pulls the cord down when the user turns the crank clockwise to open the umbrella and tilt the top portion of the umbrella. When the user turns the crank counterclockwise, the cord through hole releases the cord to allow the cord to move up at the resilient force of the spring to move the top of the umbrella to upright position, and at the gravity force of the umbrella acting on the runner of the umbrella to close the umbrella. The present invention also relates to an umbrella having such a tilting mechanism.

These and other aspects of the invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
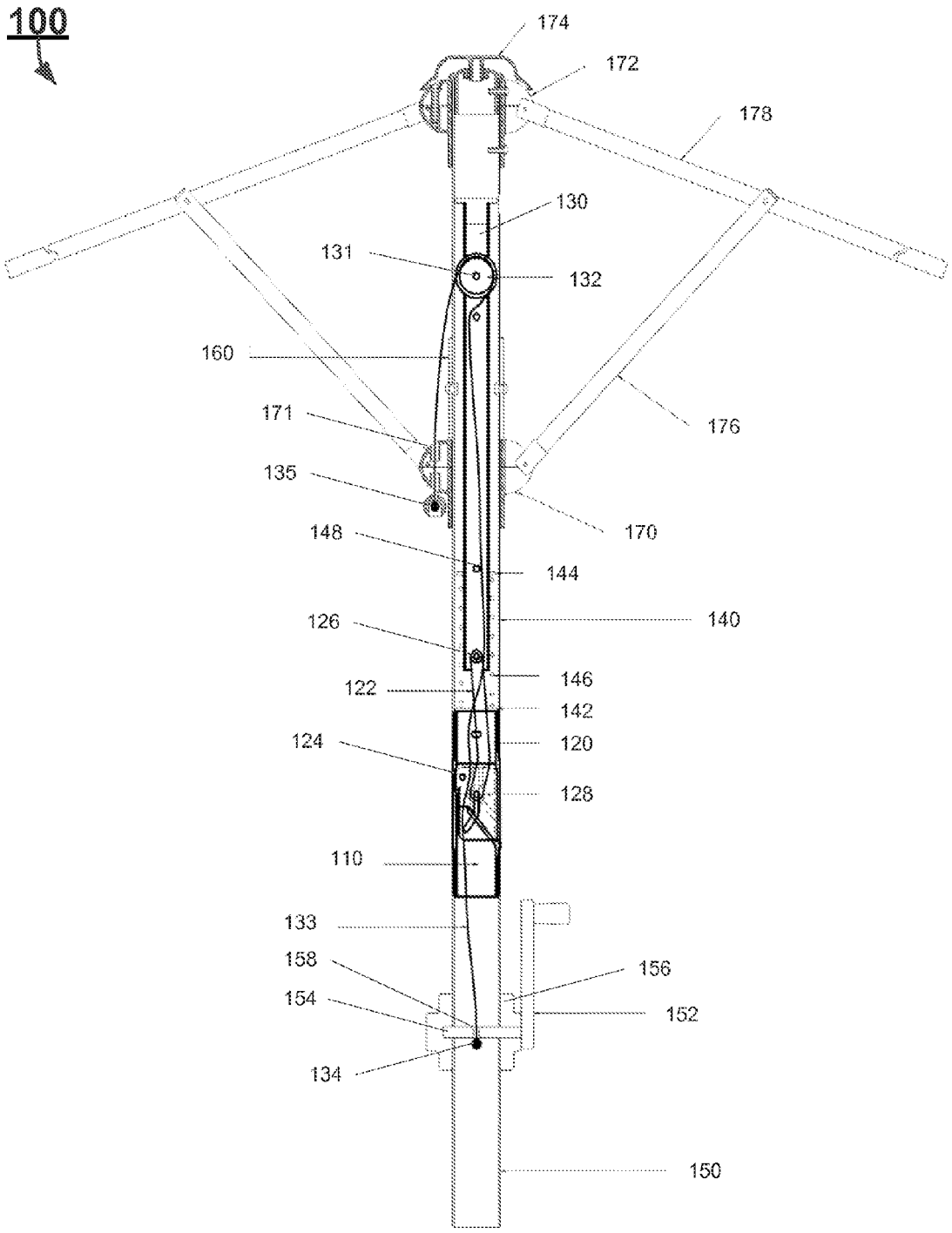
FIG. 1 is a sectional structure view of an umbrella when it is in upright and open position according to one embodiment of the present invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the invention in conjunction with the accompanying drawings in FIGS. 1-7. In accordance with the purposes of this invention, as embodied and broadly described herein, this invention, in one aspect, relates to an automatic tilt mechanism for an oversized umbrella.

Referring now to FIG. 1, a sectional structure view of an umbrella 100 is shown when it is in upright and open position according to one embodiment of the present invention. In certain embodiments, the umbrella 100 has: (a) a shaft, (b) a runner 170, (c) N stretchers 176 (where N is predetermined integer and N is greater than 1), (d) N ribs 178, (e) a top cap 172, (f) an umbrella cap 174, and (g) a canopy (not shown in FIG. 1). The shaft is divided into two portions: a lower shaft 150, and an upper shaft 140. Each of the lower shaft 150 and the upper shaft 140 has an upper end and a lower end. Each of the N stretchers 176 and the N ribs 178 has a first end and a second end. Each of the runner 170 and the top cap 172 has N slots for connecting the stretchers 176 and ribs 178. Each of the first ends of the stretchers 176 is connected by a metal ring to the runner 170. Each of the second ends of the stretchers 176 is rotatably connected at a predetermined location of middle section of a corresponding rib 178, respectively. Each of the first ends of the ribs 176 is connected by a metal ring to the top cap 172. When the runner 170 is moved upwards, the first ends of the stretchers 176 is also moved upwards causing the N ribs to move upwards and to open the canopy of the umbrella 100.

In certain embodiments, the movement of the runner 170 is controlled by a winding device 156. As shown in FIG. 1, the winding device 156 is installed on the lower shaft 150 of the umbrella 100. The winding device 156 has: (a) a crank 152, (b) a cord 133, and (c) a pulley 132. The crank 152 has a crank axle 154, and the crank axle 154 has a cord through hole 158. The cord 133 has a first end, and second end. The first end of the cord 133 has a first cord stop 134, and the second end of the cord 133 has a second cord stop 135. The cord 133 passes through the cord through hole 158 and leaves the first cord stop 134 under the cord through hole 158. The cord 133 goes up inside of the lower shaft 150, and the inside of the upper shaft 140, bending down at the pulley 132. The cord 133 ends through a runner through hole 171 to form the second cord stop 135. When a user turns the crank 152 clockwise, the cord 133 is wound around the crank axle 154 and is pulled downwards causing the runner 170 to move up and the umbrella 100 to open. The upper shaft 140 has a runner stop 160. The runner stop 160 is used to stop the runner 170 to move up further when the umbrella 100 is fully opened.

The umbrella 100 also has a base 110 and a body 120 to perform operation. The base 110 and the body 120 are joined together through a pin 124 to form a joint. The base 110 is mounted on the upper end of the lower shaft 150, and the body 120 is mounted on the lower end of the upper shaft 140. Therefore the upper shaft 140 can be tilted around the joint, as shown in the sectional structure view of FIG. 2, where the umbrella 100 is in open and titled position.

Figure 3:
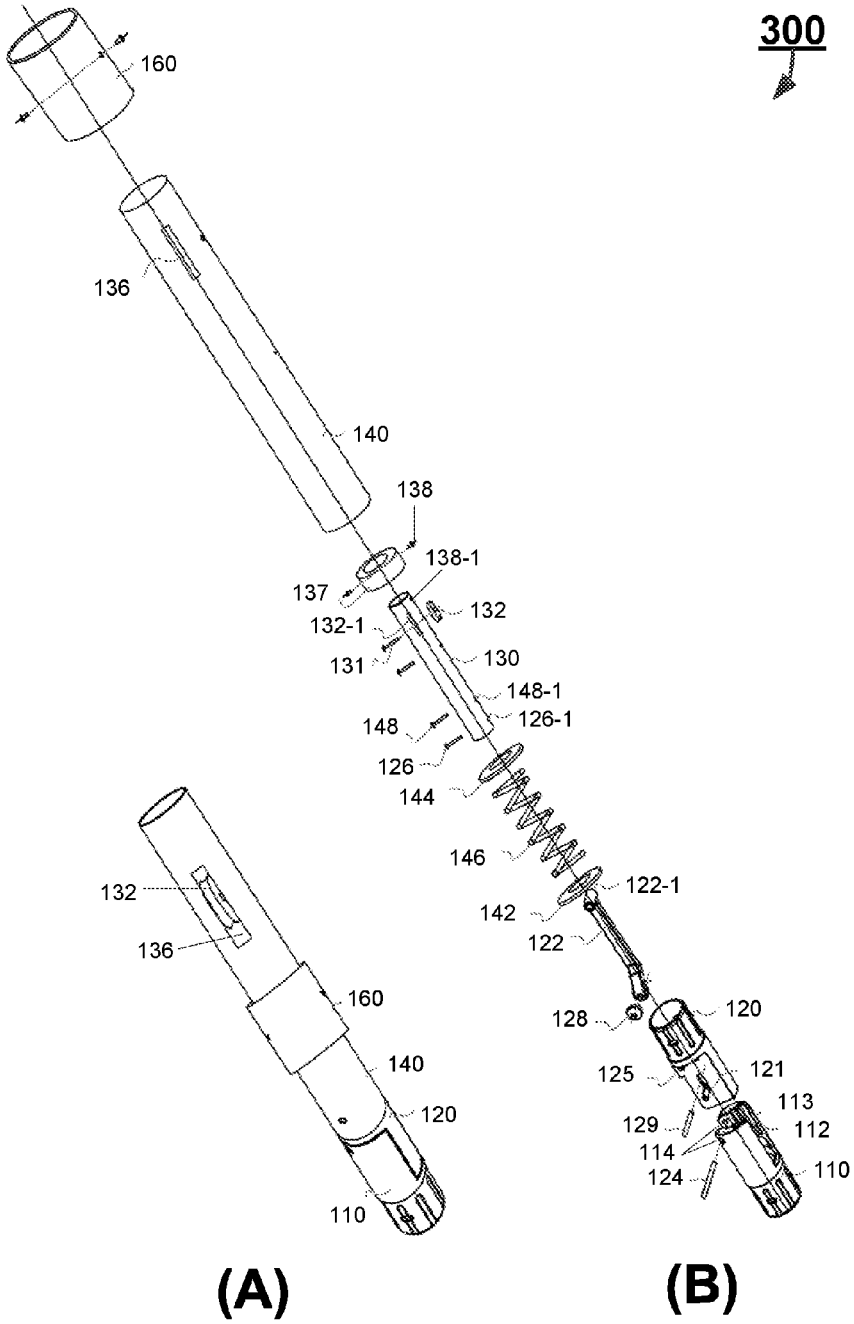
FIG. 3A is a perspective view of an assembled tilting mechanism of the umbrella and FIG. 3B is a perspective exploded view of the tilting mechanism of the umbrella according to certain embodiments of the present invention.

Referring now to FIG. 3, a perspective view of a tilting mechanism 300 of the umbrella 100 is shown in FIG. 3A, and a perspective exploded view of the tilting mechanism 300 of the umbrella 100 is shown in FIG. 3B according to certain embodiments of the present invention. The tilting mechanism 300 includes: (a) a base 110, (b) a body 120, (c) a sliding rod 130, and (d) an upper shaft 140.

Figure 4:
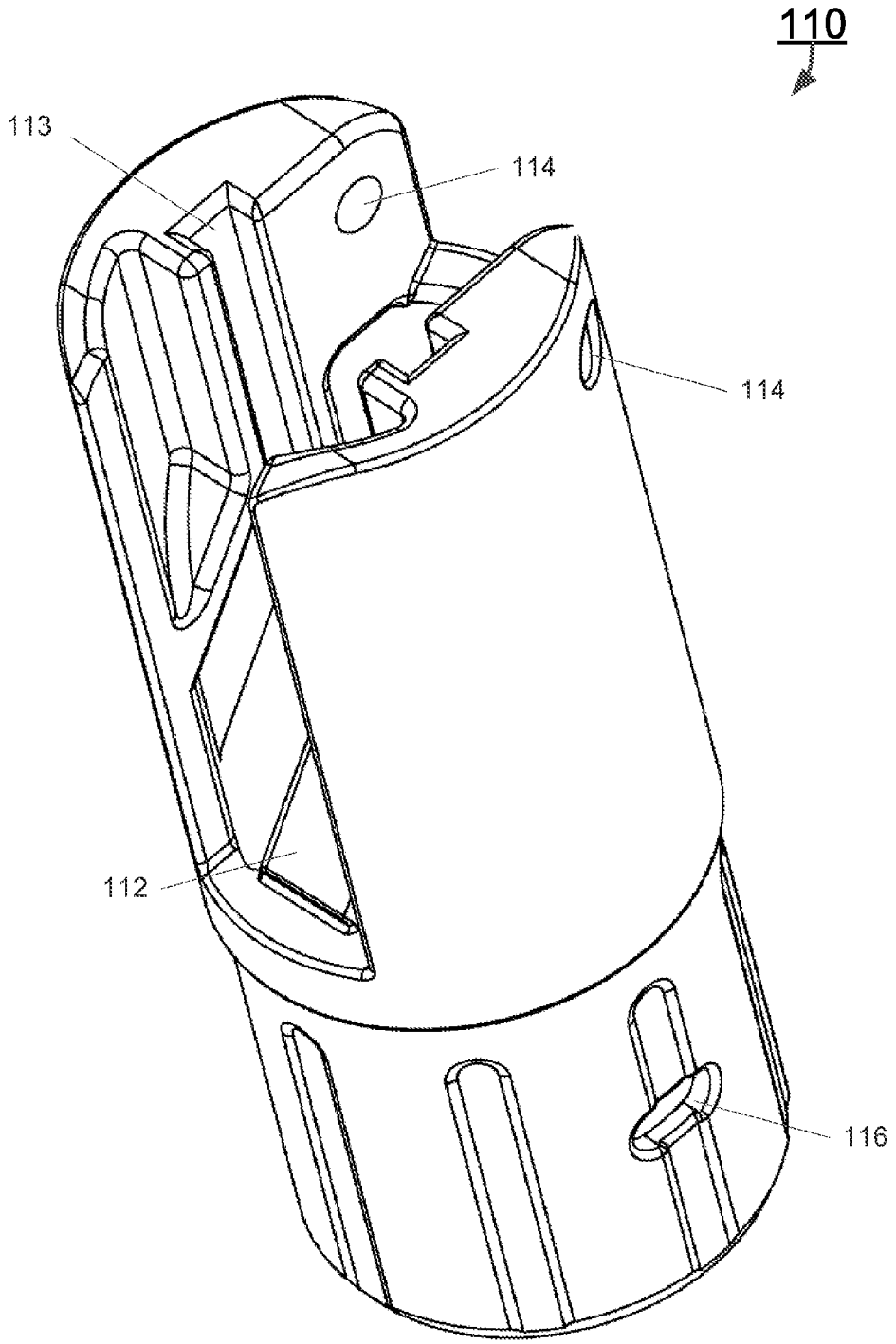
FIG. 4 is perspective view of a base of the tilting mechanism for the umbrella according to one embodiment of the present invention.

In certain embodiments, the detailed structure of the base 110 of the tilting mechanism 300 is shown in a perspective view of FIG. 4 according to one embodiment of the present invention. The base 110 has a round lower end and a "U-shaped" upper end. A pin hole 114 is provided on each side of the "U-shaped" upper end. The pin holes 114 are perpendicular to the opening of the "U-shaped" upper end, and biased towards one side of the base 110, as shown in FIG. 4. The center line of the pin hole 114 is not along the axis of the base 110. Instead, it is parallel to the axis of the base 110. A wheel axle guiding groove 113 is formed on each side wall of the opening of the "U-shaped" upper end. A wheel moving surface 112 is formed along the lower portion of the opening of the "U-shaped" upper end. The wheel moving surface 112 forms an angle against the upright direction of the base 110. The base 110 also has a base mounting hole 116 at the round lower end of the base 100, and the base mounting hole 116 is used to mount the base 110 onto the upper end of the lower shaft 150.

Figure 5:
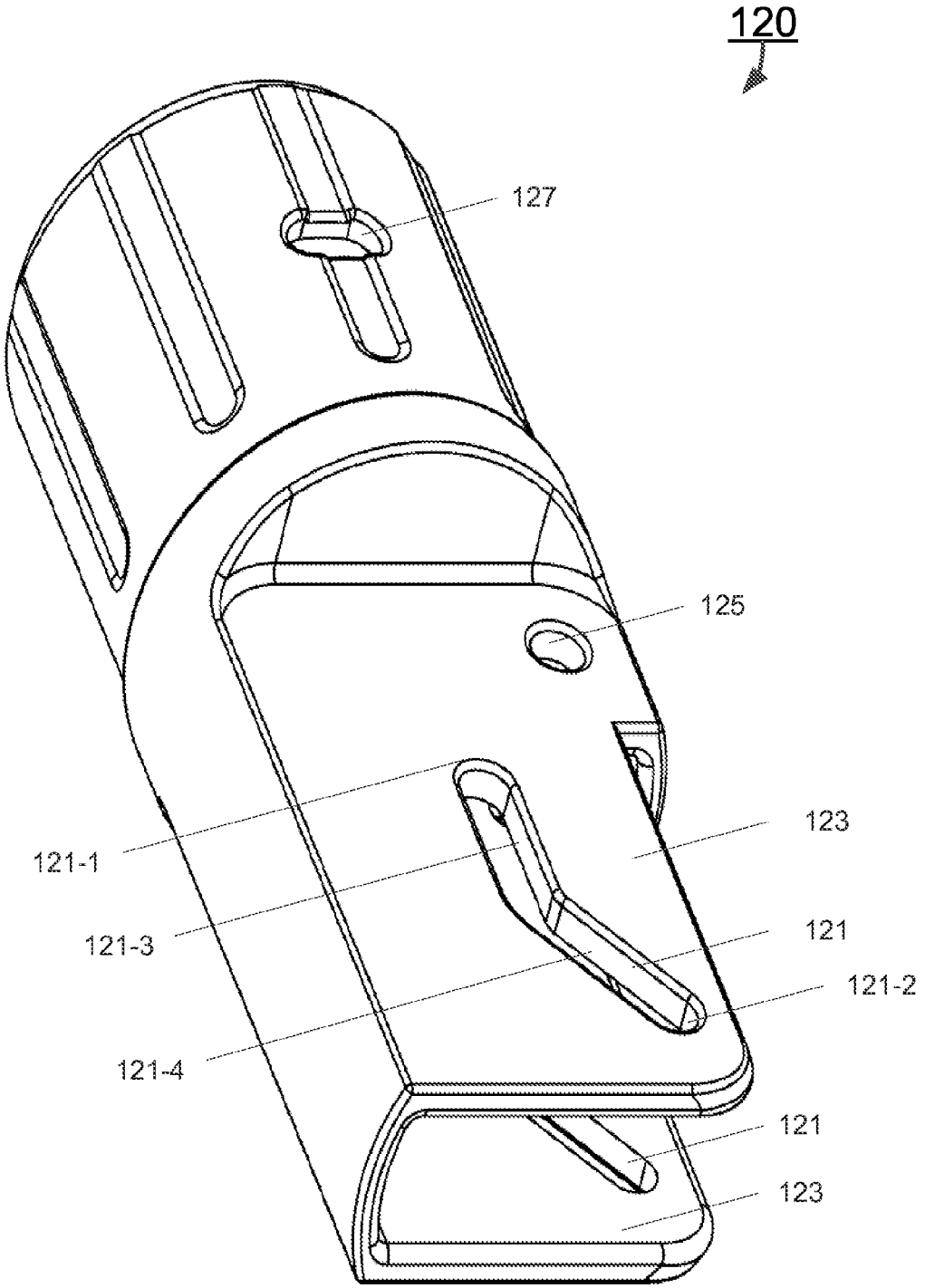
FIG. 5 is perspective view of a body of the tilting mechanism for the umbrella according to one embodiment of the present invention.

In certain embodiments, the detailed structure of the body 120 of the tilting mechanism 300 is shown in a perspective view of FIG. 5 according to one embodiment of the present invention. The body 120 has a round upper end and a "U-shaped" lower end. The U shape of the "U-shaped" lower end is turned sideways as shown in FIG. 5. A pin hole 125 is provided on each side of the "U-shaped" lower end. The pin holes 125 are perpendicular to the opening of the "U-shaped" lower end, and biased towards one side of the body 120, as shown in FIG. 5. The center line of the pin hole 125 is not along the axis of the body 120. Instead, it is parallel to the axis of the body 120. A wheel axle groove 121 is formed on each side wall of the opening of the "U-shaped" lower end. A wheel 128 is installed on a wheel axle 129, and the wheel axle 129 extends to the wheel axle grooves 121 on each side of the "U-shaped" lower portion of the body 120. The wheel axle groove 121 has a first portion 121-3, and a second portion 121-4. The groove of the first portion 121-3 of the wheel axle groove 121 is opened in vertical direction such that the wheel axle 129 travels in vertical direction in the first portion 121-3 of the wheel axle groove 121. The groove of the second portion 121-4 of the wheel axle groove 121 forms an angle against the vertical direction, such that the wheel axle 129 travels along the angular direction in the second portion 121-4 of the wheel axle groove 121. The wheel axle groove 121 has a highest point 121-1, and a lowest point 121-2. When the wheel axle 129 is at the highest point 121-1, the umbrella 100 is in upright position. When the wheel axle 129 is at the lowest point 121-2, the umbrella 100 is in tilt position.

The body 120 of the tilting mechanism 300 also has a pin 124. The pin 124 is positioned in a pin hole 125, and extended to the pin holes 114 of the base 110 to form a joint. The joint joins the base 110 and body 120.

In certain embodiments, the sliding rod 130 includes: (a) a sliding rod top ring 137, (b) a pulley 132, (c) a restricting pin 148, (d) a first washer 142, (e) a second washer 144, (f) a spring 146, and (g) an angular link rod 122. The sliding rod top ring 137 is installed on the top end of the sliding rod 130 to prevent the sliding rod 130 from horizontal movement, and secure the up and down movement of the sliding rod 130. The sliding rod 130 has a pulley slot 132-1 to allow the pulley 132 to be installed in the sliding rod 130. A pulley axle 131 is positioned horizontally to install the pulley 132. On the upper shaft 140, a cord through slot 136 is provided to allow the cord 133 to go through as the pulley 132 to move up and down along the inside of the upper shaft 140. On the lower end of the sliding rod 130, a link pin 126 is provided to connect the sliding rod 130 to the angular link rod 122. The angular link rod 122 has an upper end and a lower end. The upper end of the angular link rod 122 has an angular link rod link pin hole 122-1 to allow the link pin 126 to link the sliding rod 130 and the angular link rod 122. The lower end of the angular link rod 122 has wheel axle 129 to install a wheel 128. In one embodiment, the angular link rod 122 has an upper portion and a lower portion. The upper portion and lower portion of the angular link rod 122 for an angle such that when the wheel axle 129 travels inside the first portion of the wheel axle groove 121-3, the sliding rod 130 moves in an up and down direction, and when the wheel axle 129 travels inside the second portion of the wheel axle groove 121-4, the sliding rod 130 tilts causing the body 120 to tilt to one side around the pin 124.

In certain embodiments, the sliding rod 130 has: (a) a restricting pin 148, (b) a restricting pin hole 148-1, (c) a first washer 142, (d) a second washer 144, and (e) a spring 146. The first washer 142 is positioned on the round upper end of the body 120, the second washer 144 is positioned under the restricting pin 148. The spring 146 is installed outside of the sliding rod 130 and between the first washer 142 and the second washer 144. When the umbrella 100 is in upright position, the spring 146 pushes the second washer 144 up such that the wheel axle 129 is at the highest position of the wheel axle groove 121-1. When the user turns the crank 152 clockwise after the runner 170 is stopped by the runner stopper 160, the cord 133 pulls the pulley 132 downwards, causing the wheel axle 129 to move downwards. When the wheel axle 129 moves to the lowest position of the wheel axle groove 121-2, the auto tilt umbrellas 100 is in open and tilt position. At this time, the spring 146 is pressed. If the user releases the crank 152, or turns the crank 152 counter-clockwise, the spring 146 pushes the second washer 144 up through its resilient force to move the wheel 128 and wheel axle 129 to move up and return the tilted umbrella to its upright position.

In certain embodiments, when the umbrella 100 is in upright and closed position, a user turns the crank 152 clockwise, the cord 133 is pulled downwards, causing the runner 170 to move up and to open the umbrella 100. The runner 170 continues to move up as the user turns the cranks 152 until the runner 170 is stopped by the runner stopper 160. At this time, the umbrella 100 is in upright and fully open position. When the umbrella is in upright and open position, the user continues to turn the crank 152 clockwise, the cord 133 is pulled further down, causing the sliding rod 130 goes downwards pushing the wheel 128 to travel along the wheel moving surface 112, and the wheel axle grooves 121 push the wheel axle 129 to tilt the body 120 around the pin 124. The tilting process of the umbrella 100 will be described in detail in FIGS. 6, and 7.

Figure 6:
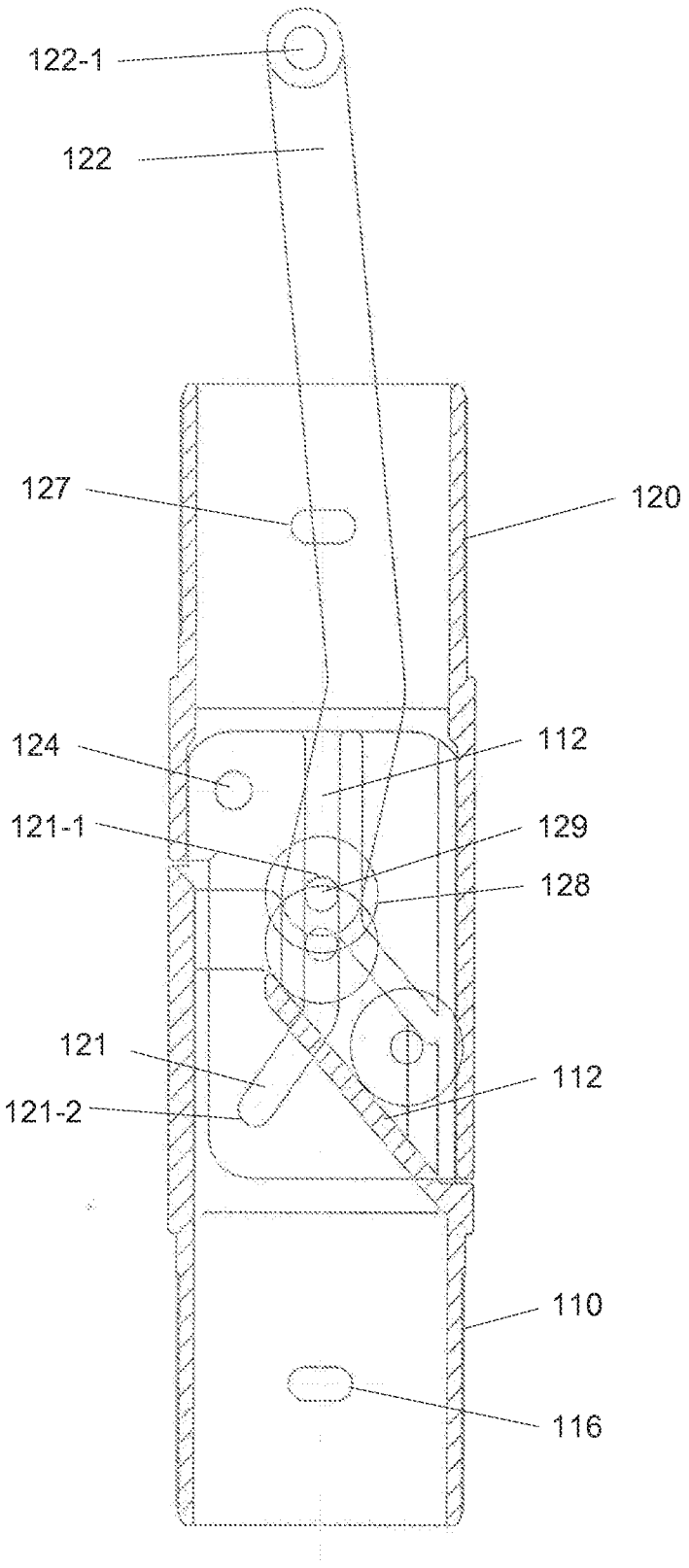
FIG. 6 is a sectional view of the tilting mechanism for the umbrella when the umbrella is in upright position according to one embodiment of the present invention.

Referring now to FIG. 6, a sectional view of the tilt mechanism for the umbrella 100 is shown when the umbrella 100 is in upright position according to one embodiment of the present invention. The wheel 128 is installed on the wheel axle 129. When the umbrella 100 is in upright position, the spring 146 pushes the second washer 144 upwards through its resilient force. The second washer 144 further pushes the restricting pin 148 placed on top of the second washer 144 causing the sliding rod 130 to slide upwards. Since the sliding rod 130 is connected to the angular link rod 122 through the angular link rod pin hole 122-1, the angular link rod 122 is also pushed upwards until the wheel axle 129 on the lower end of the angular link rod 122 is stopped at the highest point 121-1 of the wheel axle grooves 121. The spring 146 maintains the wheel axle 129 at the highest point 121-1 of the wheel axle grooves 121, and keeps the umbrella 100 in upright position. At this position, the umbrella 100 can be closed. If the user turns the crank 152 clockwise when the umbrella 100 is closed, the umbrella 100 may be opened.

Figure 2:
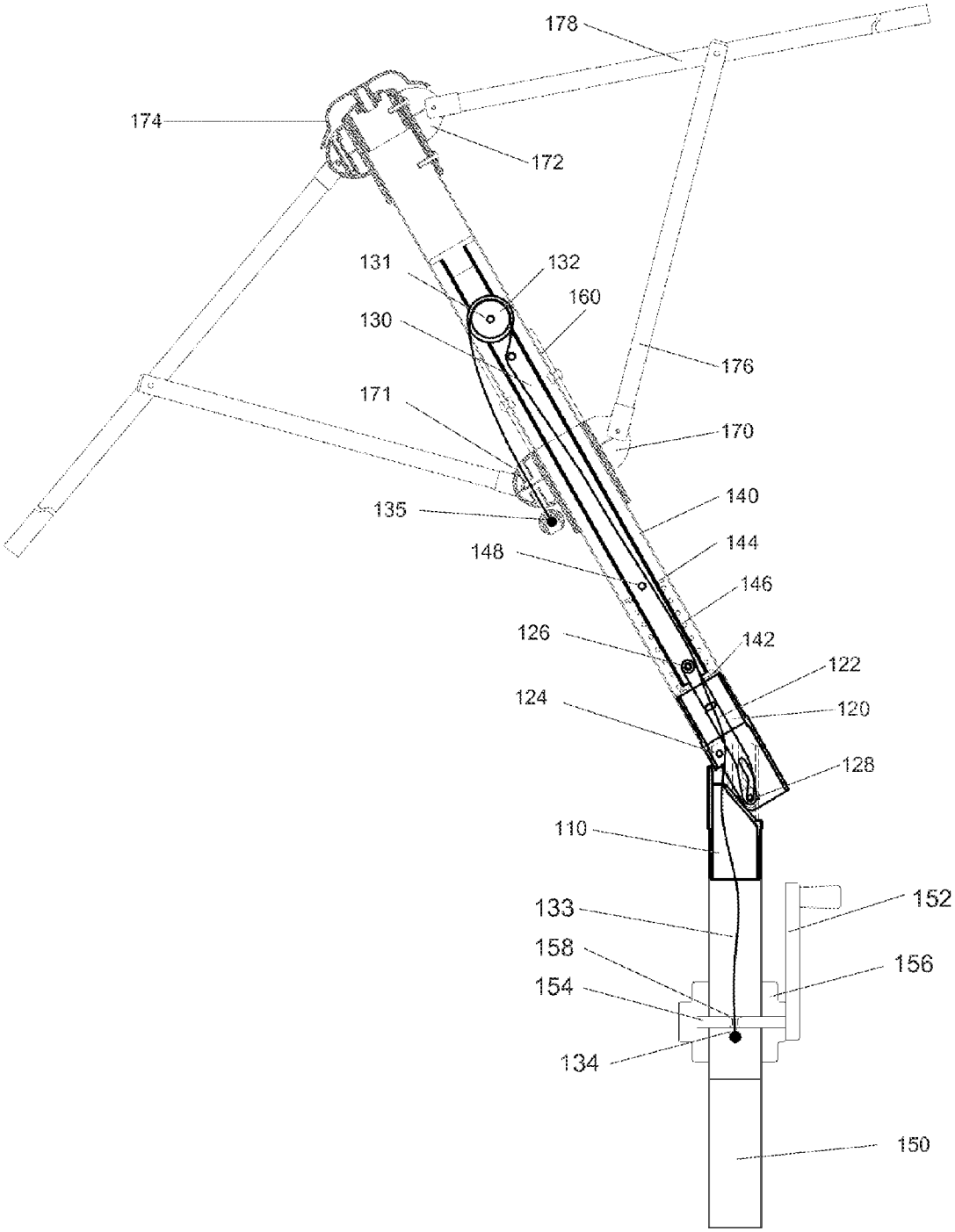
FIG. 2 is a sectional structure view of the umbrella when it is in open and titled position according to one embodiment of the present invention.
Figure 7:
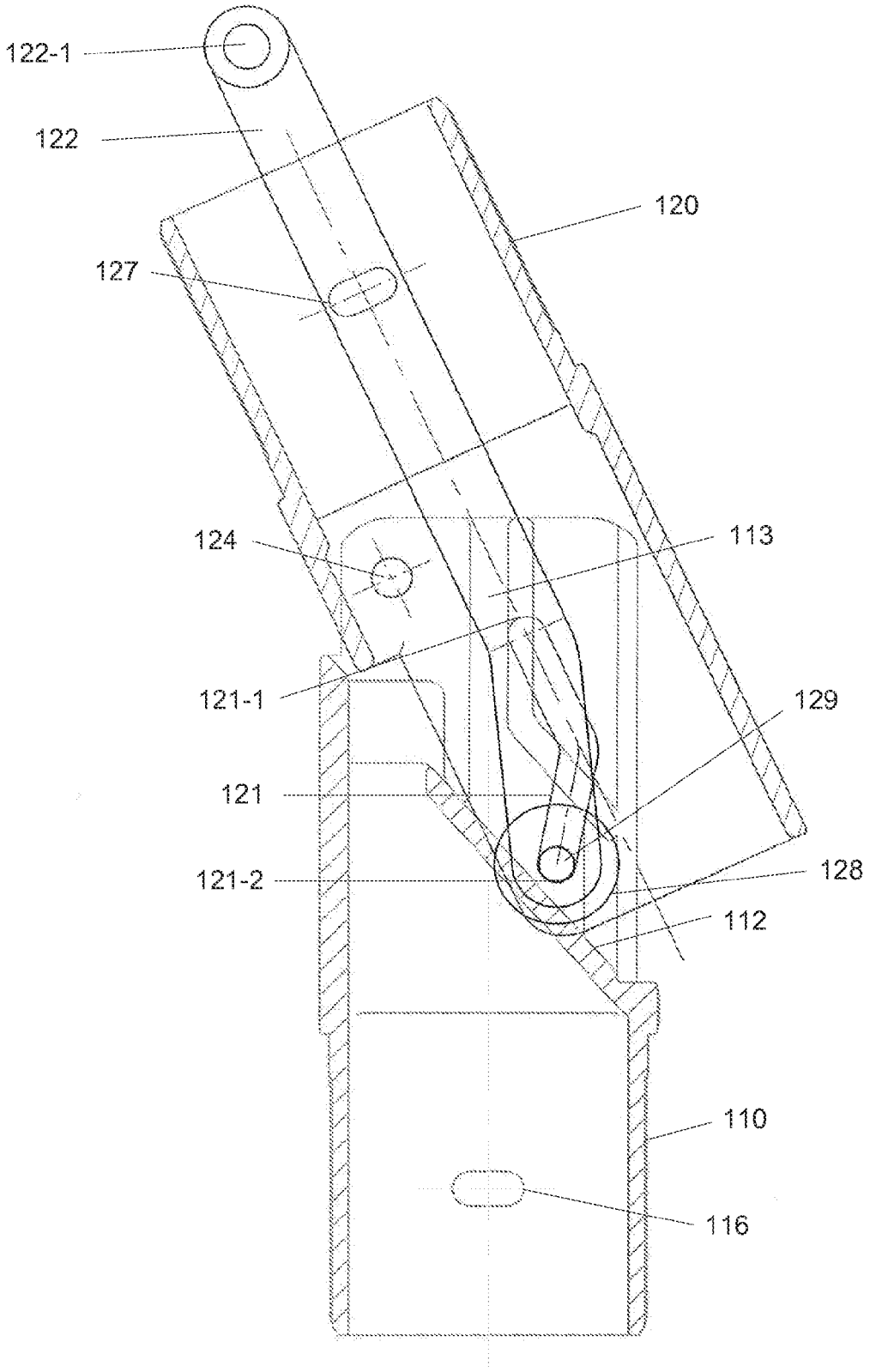
FIG. 7 is a sectional view of the tilting mechanism for the umbrella when the umbrella is in tilt position according to one embodiment of the present invention.

Referring now to FIG. 7, a sectional view of the tilt mechanism for the umbrella 100 is shown when the umbrella 100 is in tilt position according to one embodiment of the present invention. When the umbrella 100 is in upright and open position and the user turns the crank 152 clockwise when, as shown in FIGS. 1, and 2, the cord 133 is pulled downwards. Since the second end of the cord 133 is stopped at the second cord stop 135 on the runner 170, and the runner 170 is stopped by the runner stopper 160, the cord 133 pulls the pulley 132 downwards causing the sliding rod 130 to move downwards. As the sliding rod 130 moves downwards, the restricting pin 148 pushes the second washer 144 to move downwards against the resilient force of the spring 146. Since the sliding rod 130 is connected to the angular link rod 122 through the angular link rod link pin hole 122-1, the downward movement of the angular link rod 122 causes the wheel axle 129 to leave the highest point 121-1 of the wheel axle grooves 121. The wheel axle 129 moves downwards along the wheel axle guiding groove 113 on either side of the base. As the user turns the crank 152, the angular link rod 122 with the wheel 128 moves downwards and the wheel 128 touches the wheel moving surface 112. When the wheel axle 129 is further pushed downwards as the user turns the crank 152 clockwise, the wheel axle 129 moves along the curved wheel axle grooves 121, and causes the U-shaped lower end of the body 120 to move away from upright position. When the wheel 128 moves along the wheel moving surface 112 until the wheel axle 129 moves to the lowest point 121-2 of the wheel axle grooves 121, the umbrella 100 is in fully tilt position.

In another aspect, the present invention relates to an automatic tilt umbrella 100. In certain embodiments, the automatic tilt umbrella has (a) a lower shaft 150, (b) an upper shaft 140, (c) a predetermined number of ribs 178, (d) the same predetermined number of stretchers 176, (e) a top cap 172, (f) a runner 170, and (g) a tilting mechanism 300. Each of the lower shaft 150, and the upper shaft 140 has an upper end and a lower end. A first end of each of the ribs 178 is connected to the top cap 172. The runner 170 is slidably positioned on the upper shaft 140 to open, tilt, and close the automatic tilt umbrella 100. A first end of each of the stretchers 176 is connected to the runner 170, and a second end of each of the stretchers 176 is connected to a predetermined position on each of the ribs 178, respectively.

In certain embodiments, the automatic tilt umbrella 100 has a tilting mechanism 300. The tilting mechanism 300 includes (a) a base 110, (b) a body 120, (c) a sliding rod 130, and (d) a winding device 156. The base 110 of the tilting mechanism 300 has a base pin hole 114 defined substantially perpendicular to the upright direction of the base 110, and the base pin hole 114 is positioned adjacent to one side of the base 110. The base 110 has a wheel moving surface 112 and the wheel moving surface 112 is slanted against the upright direction of the base 110. The base 110 also has a wheel axle guiding groove 113 and a base mounting hole 116 defined at a lower portion of the base 110. The body 120 has a round upper portion and a U-shaped lower portion. The U-shaped lower portion forms a wheel holder 123. The wheel holder 123 has a wheel axle groove 121 on each side of the U-shaped lower portion, a pin 124 installed in a body pin hole defined in the U-shaped lower portion. The pin 124 extends to the base pin hole 114 to form a joint. The joint joins the base 110 and body 120. The body 120 also has a body mounting hole 127 defined at the round upper portion of the body 120.

The sliding rod 130 has a pulley axle 131 for mounting a pulley 132 through a pulley slot 132-1, a link pin 126 for linking an angular link rod 122. The angular link rod 122 has a first end connected through the link pin 126 to the sliding rod 130, and a second end connected to a wheel 128 through a wheel axle 129. The wheel axle 129 extends to the wheel axle grooves 121 on each side of the U-shaped lower portion of the body 120. The winding device 156 is installed on the lower shaft 150 of the automatic tilt umbrella 100. The winding device 156 has a crank 152, and a cord 133. The cord 133 has a first end, and a second end. The first end is connected to a first cord stop 134 on a crank axle 154 of the crank 152. The second end is connected to a second cord stop 135 on the runner 170 of the umbrella through a pulley positioned on the sliding rod.

In certain embodiments, when the automatic tilt umbrella 100 is in upright and closed position, a user turns the crank 152 clockwise, the cord 133 is pulled downwards, and the runner 170 is moved upwards to open the automatic tilt umbrella 100 until the runner 170 is stopped by a runner stopper 160. When the automatic tilt umbrella 100 is in upright and open position, the user continues to turn the crank 152 clockwise, the cord 133 is pulled further down, the sliding rod 130 is pushed downwards causing the wheel 128 to travel along the wheel moving surface 112, and the wheel axle grooves 121 push the wheel axle 129 to tilt the body 120 around the pin 124.

In certain embodiments, the body 120 further includes a restricting pin 148, a spring 146, a first washer 142 positioned on top of the body 120, and a second washer 144 positioned under the restricting pin 148. When the automatic tilt umbrella 100 is in upright and open position, the spring 146 is positioned between the first washer 142 and the second washer 144 to provide a resilient force to keep the sliding rod 130 away from the body 120 and maintain the wheel axle 129 in its highest position 121-1 of the wheel axle grooves 121. The base mounting hole 116 is adapted for mounting the base 110 on top of the lower shaft 150 of the automatic tilt umbrella 100. The body mounting hole 127 is adapted for mounting the body 120 at bottom of the upper shaft 140 of the automatic tilt umbrella 100.

The upper shaft 140 has a cord through slot 136 defined along the upright direction having a predetermined length to allow the cord 133 to pass from inside of the upper shaft 140 to the runner 170 and the pulley 132 to move up and down along the upright direction. The first end of the cord 133 is connected to the first cord stop 134, and the second end of the cord 133 is connected to the runner 170. The cord 133 passes from inside of the lower shaft 150, through the base 110, the body 120, inside of the upper shaft 140, the pulley 132, through the cord through slot 136 to come out of the upper shaft 140 and connect to the second cord stop 135. The runner stopper 160 is positioned on the upper shaft 140 to stop the runner 170 when the automatic tilt umbrella 100 is in upright and open position.

In certain embodiments, the sliding rod 130 has a sliding rod top ring 137, a sliding rod top ring mounting hole 138-1 defined substantially perpendicular to the upright direction of the base 110 through the sliding rod top ring 137, and two mounting screws 138 to mount the sliding rod top ring 137 on the top end of the sliding rod 130. The sliding rod 130 has a pulley slot 132-1 adapted for installing the pulley 132 on a pulley axle 131. The sliding rod 130 is slidably positioned inside of the upper shaft 140. The position of the sliding rod 130 is controlled by the cord 133 through the pulley 132 to allow the sliding rod 130 to move down to tilt the upper shaft 140 of the automatic tilt umbrella 100, or move up to return the upper shaft 140 of the automatic tilt umbrella 100 to upright position.

In certain embodiments, the winding device 156 has a crank axle 154, and the crank axle 154 has a cord through hole 158 defined substantially parallel to the upright direction of the base 110 through the crank axle 154. The cord through hole 158 holds the first end stop 134 at the first end of the cord 133, and pulls the cord 133 down when the user turns the crank 152 clockwise to open the umbrella and tilt the top portion of the automatic tilt umbrella 100. When the user turns the crank counterclockwise, the cord through hole 158 releases the cord 133 to allow the cord 133 to move up at the resilient force of the spring 146 to move the top of the automatic tilt umbrella 100 to upright position, and at the gravity force of the automatic tilt umbrella 100 acting on the runner 170 of the automatic tilt umbrella 100 to close the automatic tilt umbrella 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A tilting mechanism used in an umbrella, comprising:

a base, having a base pin hole defined substantially perpendicular to the upright direction of the base proximate to one side of the base, a wheel moving surface slanted against the upright direction of the base, a wheel axle guiding groove, and a base mounting hole defined at a lower portion of the base, the base mounting hole adapted for mounting the base on top of a lower shaft of the umbrella;

a body, having a round upper portion and a U-shaped lower portion forming a wheel holder having a wheel axle groove on each side of the U-shaped lower portion, a pin positioned in a body pin hole defined in the U-shaped lower portion, the pin extending to the base pin hole of the base to form a joint joining the base and the body, a body mounting hole defined at the round upper portion of the body, a restricting pin, a spring, a first washer positioned on top of the body, and a second washer positioned under the restricting pin, wherein the spring is installed between the first washer and the second washer to provide a resilient force to keep the sliding rod away from the body and maintain the wheel axle in its highest position of the wheel axle grooves, when the umbrella is in an upright and open position, and wherein the body mounting hole is adapted for mounting the body at bottom of an upper shaft of the umbrella;

a sliding rod, having a pulley axle for mounting a pulley, a link pin for linking an angular link rod, a sliding rod top ring, a sliding rod top ring mounting hole defined substantially perpendicular to the upright direction of the base through the sliding rod top ring, two mounting screws to mount the sliding rod top ring on the top end of the sliding rod, and a pulley slot adapted for installing the pulley on the pulley axle, wherein the angular link rod has a first end connected through the link pin to the sliding rod, and a second end connected to a wheel through a wheel axle and wherein the wheel axle extends to the wheel axle grooves on each side of the U-shaped lower portion of the body; and a winding device installed on the lower shaft of the umbrella, having a crank, and a cord having a first end connected to a first cord stop on a crank axle of the crank, and a second end connected to a second cord stop on a runner of the umbrella through the pulley positioned on the sliding rod, wherein, when the umbrella is in an upright and closed position, a user turns the crank clockwise, the cord is pulled downwards, causing the runner to move upwards to open the umbrella until the runner is stopped by a runner stopper, and when the umbrella is in the upright and open position, the user continues to turn the crank clockwise, the cord is pulled further down, the sliding rod is pushed downwards causing the wheel to travel along the wheel moving surface, and the wheel axle grooves push the wheel axle to tilt the body around the pin.

2. The tilting mechanism of claim 1, wherein the upper shaft comprises a cord through slot defined along the upright direction having a predetermined length to allow the cord to pass from inside of the upper shaft to the runner and the pulley to move up and down along the upright direction.

3. The tilting mechanism of claim 1, wherein the first end of the cord is connected to the first cord stop, and the second end of the cord is connected to the runner, wherein the cord passes from inside of the lower shaft, through the base, the body, inside of the upper shaft, the pulley, through a cord through slot to come out of the upper shaft and connect to the second cord stop.

4. The tilting mechanism of claim 1, wherein the runner stopper is positioned on the upper shaft to stop the runner when the umbrella is in the upright and open position.

5. The tilting mechanism of claim 4, wherein the sliding rod is slidably positioned inside of the upper shaft and the position of the sliding rod is controlled by the cord through the pulley to allow the sliding rod to move down to tilt the upper shaft of the umbrella, or move up to return the upper shaft of the umbrella to the upright position.

6. The tilting mechanism of claim 1, wherein the winding device further comprises a crank axle having a cord through hole defined substantially parallel to the upright direction of the base through the crank axle, wherein the cord through hole holds the first end of the cord, and the cord through hole pulls the cord down when the user turns the crank clockwise to open the umbrella and tilt the top portion of the umbrella, and the cord through hole releases the cord to allow the cord to move up at the resilient force of the spring to move the top of the umbrella to the upright position, and allow the gravitational force of the umbrella acting on the runner of the umbrella to close the umbrella, when the user turns the crank counterclockwise.

7. An umbrella comprising the tilting mechanism of the claim 1.

8. An umbrella, comprising:

a lower shaft having an upper end and a lower end;

an upper shaft having an upper end and a lower end;

a plurality of ribs;

a top cap, wherein a first end of each of the plurality of ribs is connected to the top cap;

a runner slidably positioned on the upper shaft to open, tilt, and close the umbrella;

a plurality of stretchers, wherein a first end of each of the plurality of the stretchers is connected to the runner, and a second end of each of the plurality of the stretchers is connected to a predetermined position on each of the plurality of ribs, respectively; and a mechanism, having a base, having a base pin hole defined substantially perpendicular to the upright direction of the base proximate to one side of the base, a wheel moving surface slanted against the upright direction of the base, a wheel axle guiding groove, and a base mounting hole defined at a lower portion of the base, the base mounting hole adapted for mounting the base on top of the lower shaft of the umbrella;

a body, having a round upper portion and a U-shaped lower portion forming a wheel holder having a wheel axle groove on each side of the U-shaped lower portion, a pin positioned in a body pin hole defined in the U-shaped lower portion, the pin extending to the base pin hole of the base to form a joint joining the base and the body, a body mounting hole defined at the round upper portion of the body, a restricting pin, a spring, a first washer positioned on top of the body, and a second washer positioned under the restricting pin, wherein the spring is installed between the first washer and the second washer to provide a resilient force to keep the sliding rod away from the body and maintain the wheel axle in its highest position of the wheel axle grooves, when the umbrella is in an upright and open position, and wherein the body mounting hole is adapted for mounting the body at bottom of the upper shaft of the umbrella;

a sliding rod, having a pulley axle for mounting a pulley, a link pin for linking an angular link rod, a sliding rod top ring, a sliding rod top ring mounting hole defined substantially perpendicular to the upright direction of the base through the sliding rod top ring, two mounting screws to mount the sliding rod top ring on the top end of the sliding rod, and a pulley slot adapted for installing the pulley on the pulley axle, wherein the angular link rod has a first end connected through the link pin to the sliding rod, and a second end connected to a wheel through a wheel axle and wherein the wheel axle extends to the wheel axle grooves on each side of the U-shaped lower portion of the body; and a winding device installed on the lower shaft of the umbrella, having a crank, and a cord having a first end connected to a first cord stop on a crank axle of the crank, and a second end connected to a second cord stop on the runner of the umbrella through the pulley positioned on the sliding rod, wherein, when the umbrella is in an upright and closed position, a user turns the crank clockwise, the cord is pulled downwards, causing the runner to move upwards to open the umbrella until the runner is stopped by a runner stopper, and when the umbrella is in the upright and open position, the user continues to turn the crank clockwise, the cord is pulled further down, the sliding rod is pushed downwards causing the wheel to travel along the wheel moving surface, and the wheel axle grooves push the wheel axle to tilt the body around the pin.

9. The umbrella of claim 8, wherein the upper shaft comprises a cord through slot defined along the upright direction having a predetermined length to allow the cord to pass from inside of the upper shaft to the runner and the pulley to move up and down along the upright direction.

10. The umbrella of claim 8, wherein the first end of the cord is connected to the first cord stop, and the second end of the cord is connected to the runner, wherein the cord passes from inside of the lower shaft, through the base, the body, inside of the upper shaft, the pulley, through a cord through slot to come out of the upper shaft and connect to the second cord stop.

11. The umbrella of claim 8, wherein the upper shaft is connected to the runner stopper to stop the runner when the umbrella is in the upright and open position.

12. The umbrella of claim 8, wherein the sliding rod is slidably positioned inside of the upper shaft and the position of the sliding rod is controlled by the cord through the pulley to allow the sliding rod to move down to tilt the upper shaft of the umbrella, or move up to return the upper shaft of the umbrella to the upright position.

13. The umbrella of claim 8, wherein the winding device further comprises a crank axle having a cord through hole defined substantially parallel to the upright direction of the base through the crank axle, wherein the cord through hole holds the first end of the cord, and the cord through hole pulls the cord down when the user turns the crank clockwise to open the umbrella and tilt the top portion of the umbrella, and the cord through hole releases the cord to allow the cord to move up at the resilient force of the spring to move the top of the umbrella to the upright position, and allow the gravitational force of the umbrella acting on the runner of the umbrella to close the umbrella, when the user turns the crank counterclockwise.

* * * * *